US005941462A

United States Patent [19]

Sandor

[11] Patent Number: 5,941,462

[45] **Date of Patent: *Aug. 24, 1999**

[54] VARIABLE SPRAY NOZZLE FOR PRODUCT SPRAYER

[75] Inventor: Joseph Sandor, Newport Beach, Calif.

[73] Assignee: John R. Woods, Woodland Hills, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/823,902

[22] Filed: Mar. 25, 1997

[51] Int. Cl.[6] ..... B05B 1/30

[52] U.S. Cl. ..... 239/546; 239/602

[58] Field of Search ..... 239/546, 519, 239/597, 451, 601, 602, 587.1, 558, DIG. 12, DIG. 19; 251/340, 342

[56] References Cited

U.S. PATENT DOCUMENTS

| | | | |
|---|---|---|---|
| 96,862 | 11/1869 | Allen | 239/546 |
| 161,763 | 4/1875 | Curtis | 239/546 |
| D. 198,356 | 6/1964 | Wahlin et al. | D91/1 |
| 1,681,230 | 8/1928 | Gooseide | 239/601 |
| 1,829,878 | 11/1931 | Sims et al. | 239/601 |
| 3,254,869 | 6/1966 | Easey | 239/546 |
| 3,719,328 | 3/1973 | Hindman | 239/546 |
| 5,080,286 | 1/1992 | Morrison | 239/533.13 |
| 5,323,963 | 6/1994 | Ballu | 239/63 |
| 5,370,318 | 12/1994 | Weston | 239/533.14 |
| 5,421,519 | 6/1995 | Woods | 239/394 |

*Primary Examiner*—Andres Kashnikow
*Assistant Examiner*—Lisa A. Douglas
*Attorney, Agent, or Firm*—Pillsbury Madison & Sutro LLP

[57] ABSTRACT

A spray nozzle assembly composed of a support member defining a product flow path for conducting a flowable product which is to exit the nozzle assembly in the form of a spray; a spray nozzle member providing a spray opening communicating with the flow path, the spray nozzle member being operative for emitting the flowable product from the spray opening in a form determined by the size and shape of the spray opening; and a holding member for holding the spray nozzle member in position relative to the support member, wherein the spray nozzle member is made of an elastic material which is deformable in a manner to vary the size of the spray opening, and the holding member is movable relative to the support member for deforming the elastic material of the spray nozzle member to vary the size of the spray opening.

19 Claims, 4 Drawing Sheets

VARIABLE SPRAY NOZZLE FOR PRODUCT SPRAYER

BACKGROUND OF THE INVENTION

The present invention relates to apparatus for spraying a variety of fluid or semi-fluid products including, but not limited to, coating products, cleaning products, hairsprays, and the like.

In such apparatus, a product in fluid form is placed under pressure or is entrained in a carrier fluid under pressure and is then emitted from a nozzle in the form of a spray having a certain dispersion pattern. The configuration of the dispersion pattern depends, inter alia, on the size and shape of the spray opening formed in the nozzle.

U.S. Pat. No. 5,421,519 discloses a spray nozzle having a plurality of spray openings, each having a different size. The nozzle can be rotated to bring a selected spray opening into position to produce a spray. In this manner, a limited number of spray dispersion patterns can be produced from a single nozzle. Nozzle size influences both dispersion pattern and spray droplet size.

These nozzles have only a limited number of settings and are made of a number of parts whose assembly requires a certain level of skill and dexterity.

SUMMARY OF THE INVENTION

It is an object of the present invention to produce a spray which is infinitely variable over a finite range.

Another object of the invention is to provide a variable nozzle which is structurally simple and easy to assemble.

A further object of the invention is to provide a nozzle which can be varied by the user to produce a number of different dispersion pattern sizes.

An additional object of the invention is to provide a nozzle which can be configured to produce a variety of dispersion pattern shapes.

The above and other objects are achieved according to the invention by a spray nozzle assembly comprising:

- a support member defining a product flow path for conducting a flowable product which is to exit the nozzle in the form of a spray;
- a spray nozzle member for providing a spray opening communicating with the flow path, the member being operative for emitting the flowable product from the spray opening in a dispersion pattern determined by the size and shape of the spray opening; and
- a holding member for holding the spray nozzle member in position relative to said support member,
- wherein the spray nozzle member comprises an elastic material which is deformable in a manner to vary the size of the spray opening, and the holding member is movable relative to the support member for deforming the elastic material of the spray nozzle member to vary the size of the spray opening.

DESCRIPTION OF THE PREFERRED EMBODIMENTS

Figure 3:
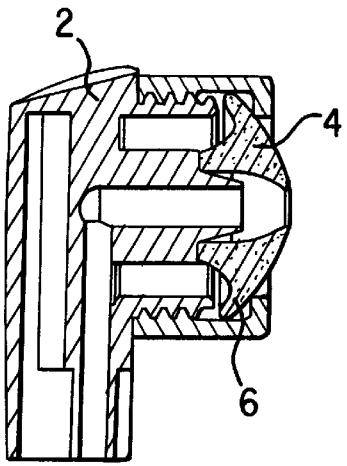
FIGS. 1, 2 and 3 are cross-sectional elevational views of one embodiment of a spray nozzle assembly according to the invention.
Figure 2:
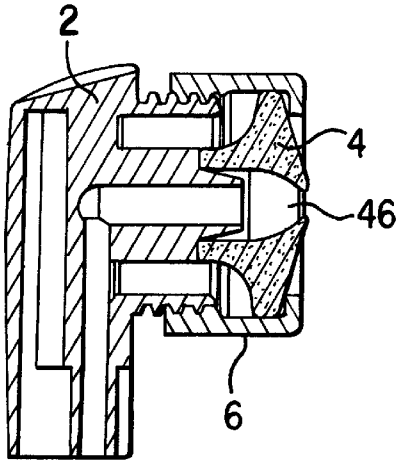
Figure 1:
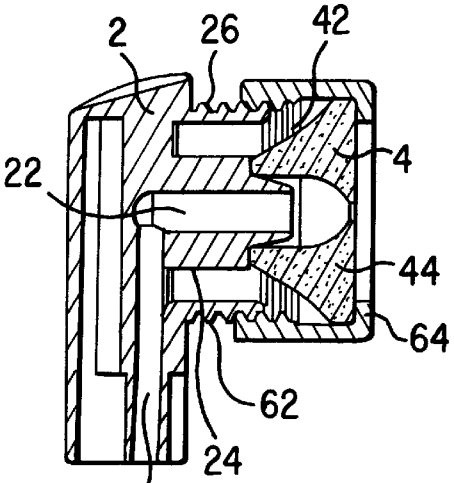

FIGS. 1, 2 and 3 are cross-sectional views of an assembly according to one embodiment of the invention in three different operating states. The illustrated embodiment is a spray head made up of a support member 2, a spray nozzle member 4 and a holding member 6.

The spray head will be mounted at the top of a can containing a product which is stored under pressure and which is to be dispensed in the form of a spray. Support member 2 defines a product flow path having an upstream section 20 and a downstream section 22. Upstream section 20 has an inlet end which may be coupled, in a conventional manner, to a valve (not shown) that controls delivery of the product to the flow path. Typically, the valve would be opened to disperse product by depressing the spray head so that it is displaced downwardly relative to the can.

In the illustrated embodiment, downstream section 22 is perpendicular to upstream section 20 and is formed in a cylindrical part 24 of support member 2. Cylindrical part 24 is formed to have a male screw thread 26 on its outer cylindrical surface.

Spray nozzle member 4 is cylindrical, or axially symmetrical, and is composed of a base part 42 and a flange part 44. Base part 42 is provided to secure spray nozzle member 4 to support member 2. For this purpose, support member 2 is provided with a circular shoulder, shaped to receive the free end of base part 42. As will become clear from the following description, a snug fit need not be created between base part 42 and the shoulder in support member 2; it is only necessary that spray nozzle member 4 be temporarily held in place on support member 2 until holding member 6 has been mounted on support member 2.

Spray nozzle member 4 is formed to provide a flow chamber 46 which extends from an inlet end adjacent the outlet end of support member 2 to an outlet end remote from the outlet end of downstream section 22. The size and shape of sections 20 and 22 have no influence on the resulting spray pattern. The outlet end of flow chamber 46 defines a spray opening 48 whose size and shape will control the spray emitted from flow passage 46.

Holding member 6 is essentially a cylindrical member of circular cross section having an interior surface provided at one end with a female thread 62 that mates with thread 26 and at its other end with an inwardly directed flange 64 that will bear against flange 44 when holding member 6 has been mounted on support member 2 and advanced several turns along cylindrical part 24.

When holding member 6 has been screwed onto cylindrical part 24 to the point at which holding member 64 contacts flange 44 without measurably deforming flange 44, spray opening 48 has its minimum size, or diameter, and will emit a fine spray. At the same time, holding member 6 will hold spray nozzle member 4 in place relative to cylindrical part 24. This is the state shown in FIG. 1.

When, as shown in FIG. 2, holding member 6 has been advanced several more turns onto cylindrical part 24, holding member 64 will have displaced the outer edge of flange 44 in a direction along the axis of flow passage 46, deforming at least the portion of spray nozzle member 4 around spray opening 48 to expand spray opening 48 in an axially symmetric manner to a medium spray state.

Finally, as shown in FIG. 3, when spray nozzle member 4 has advanced fully onto cylindrical support 24, spray opening 48 is expanded in an axially symmetric manner to its maximum diameter.

For all positions of spray nozzle member 4 relative to cylindrical support 24, spray opening 48 is smaller in diameter than the inlet end of flow passage 46 and flow passage 46 preferably decreases from its inlet end to spray opening 48. Thus, as the diameter of spray opening 48 increases, the diameter decrease of flow passage 46 becomes more gradual.

It will be appreciated that holding member 6 can be advanced to any position between those shown in FIGS. 1 and 3 prior to spraying, which means that the size of spray opening 48 is infinitely variable over that range.

Figure 7:
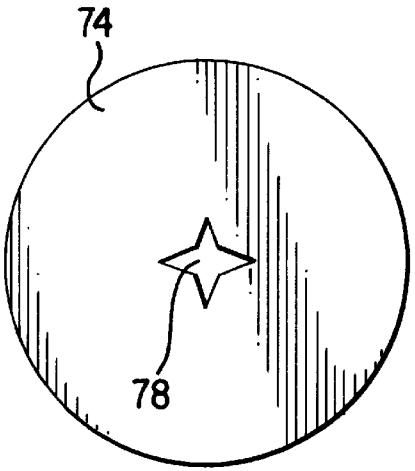
FIGS. 5, 6, 7 and 8 are front elevational views of alternative embodiments of one component of the assembly shown in FIGS. 1–3.
Figure 6:
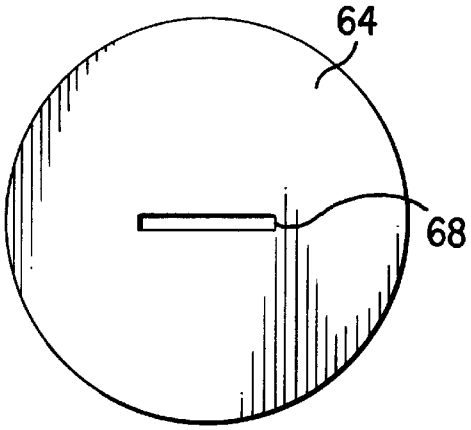
Figure 8:
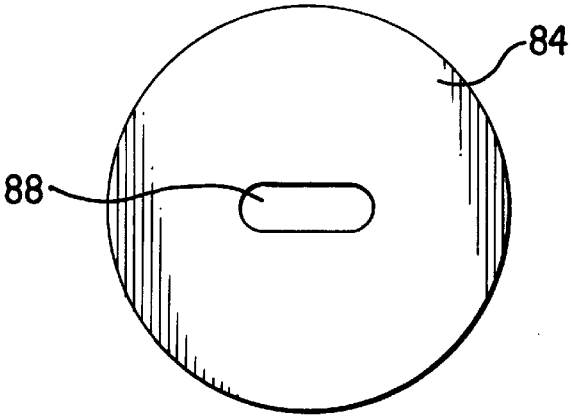
Figure 5:
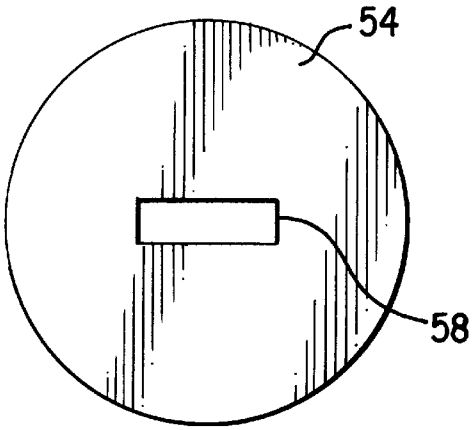
Figure 9:
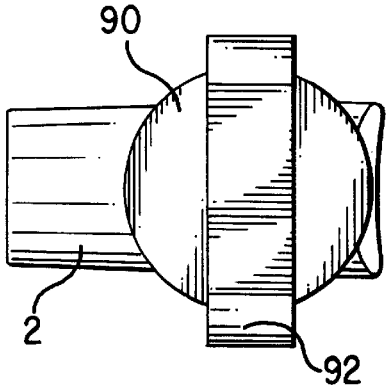
FIGS. 9, 10, 11 and 12 are, respectively, a rear elevational view, a side elevational view, a top plan view and a front elevational view of a second embodiment of a spray nozzle assembly according to the invention.
Figure 10:
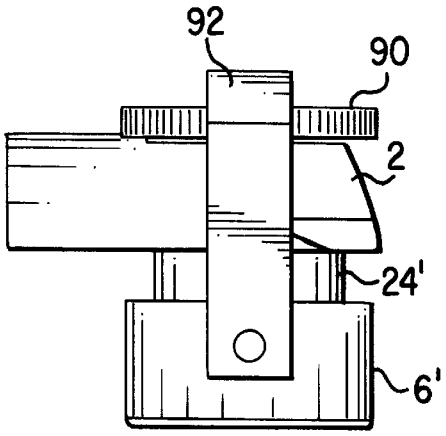
Figure 11:
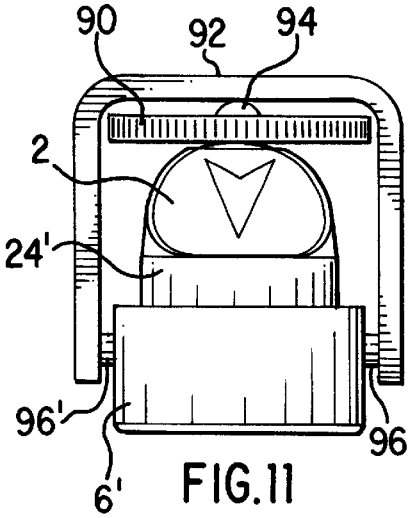
Figure 12:
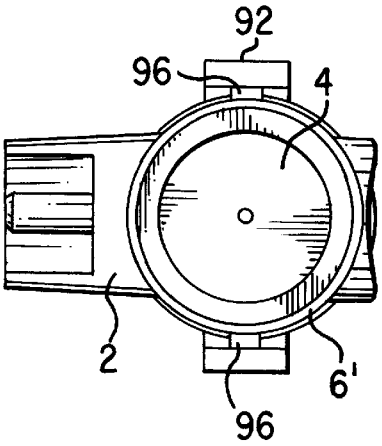

Spray nozzle member 4 is preferably a one-piece, homogenous body of a resilient elastic material, such as silicone, rubber, sponge, etc. While passage 46 and spray opening 48 will have a circular cross section, other cross-sectional shapes may be provided, including rectangles, slits, squares, stars, etc. By way of nonlimiting examples, FIG. 5 shows a spray nozzle member 54 provided with a rectangular spray opening 58, FIG. 6 shows a spray nozzle member 64 provided with a slit-shaped spray opening 68, FIG. 7 shows a spray nozzle member 74 provided with a stelliform spray opening 78 and FIG. 8 shows a spray nozzle member 84 provided with an oval spray opening 88. In all embodiments, the inlet end of passage 46 will be circular and the cross section of passage 46 will undergo a progressive transition, along the length of passage 46, to the form of the spray opening, so that the outlet end of passage 46 will have the same form and size as the spray opening.

Figure 4:
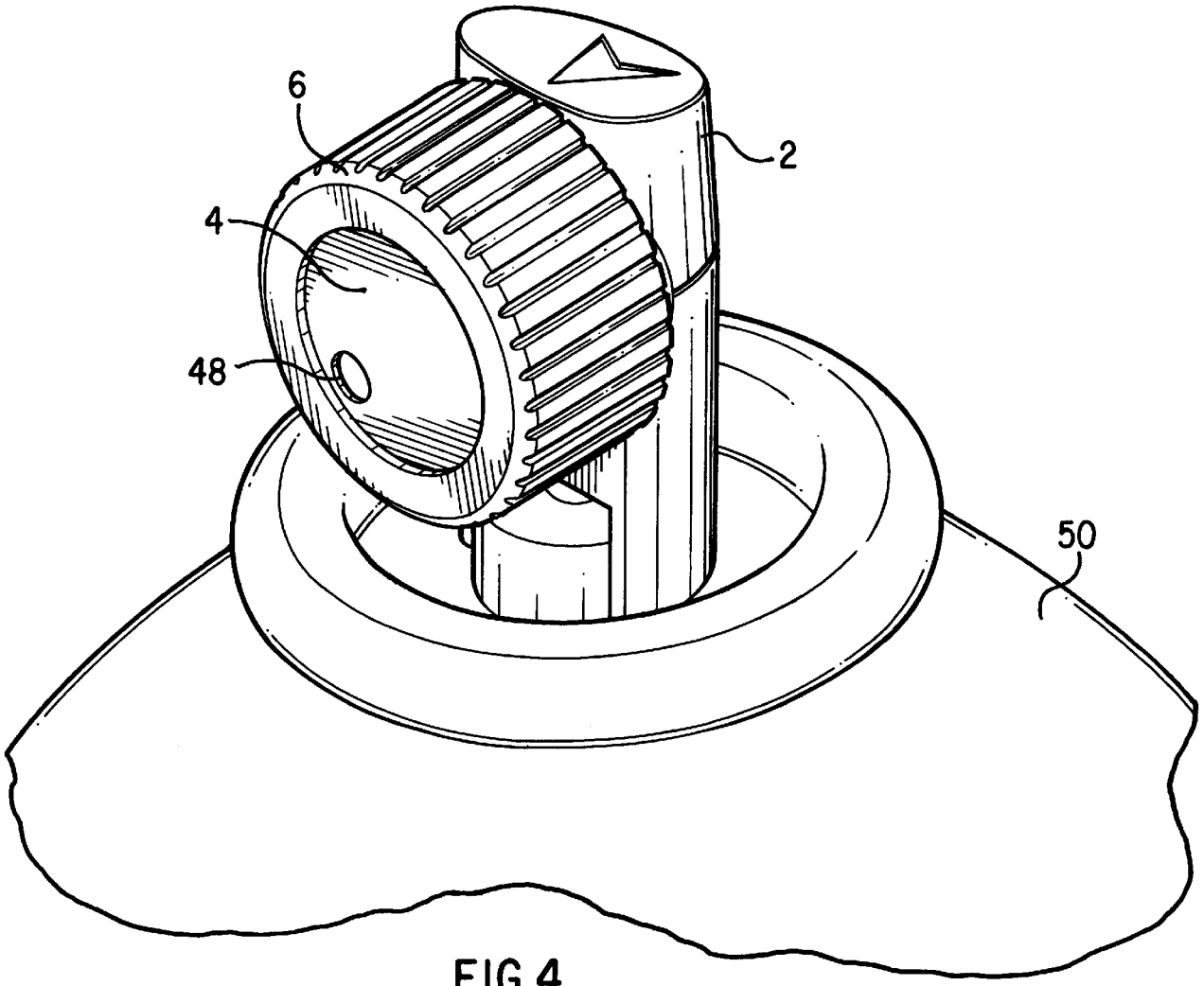
FIG. 4 is a perspective view showing the assembly of FIGS. 1–3 mounted on a spray can.

FIG. 4 is a perspective view showing the assembly of FIGS. 1–3 mounted at the top of a spray can 50. The fluid product contained in can 50 can be dispensed in the conventional manner simply by depressing support member 2.

An assembly according to the invention can also be configured and mounted so that the longitudinal axis of flow passage 46, and hence the axis of the resulting spray, is aligned with the longitudinal axis of the spray can. Such an assembly can have the general form of known dispensers for products such as shaving cream and viscous food products in which the nozzle is pivotally mounted on the dispenser can and is depressed sideways to open the valve and dispense the product.

According to further embodiments of the invention, cylindrical part 24 and holding member 6 can be constructed and coupled to allow holding member 6 to slide along cylindrical part 24, without rotation. For this purpose, holding member 6 may be coupled to cylindrical part 24 by a suitable manually operable lever or linkage mechanism.

One example of this further embodiment is illustrated in FIGS. 9, 10, 11 and 12. In this embodiment, a holding member 6' is mounted on a cylindrical part 24' of support member 2. Cylindrical part 24' and holding member 6' are identical to parts 24 and 6 of the embodiments shown in FIGS. 1–4, except that cylindrical part 24' is not provided with a male thread and holding member 6' is not provided with a female thread, so that member 6' can slide along the cylindrical outer surface of cylindrical part 24' in the direction of flow path section 22.

The movement of holding member 6' along the outer surface of part 24' parallel to the axis of product flow path section 22 is controlled by a mechanism composed of a thumb wheel 90 and a U-shaped stirrup 92.

Thumb wheel 90 carries a threaded shaft, or post (not shown) which is screwed into a threaded opening in the rear surface of support member 2. In addition, thumb wheel 90 carries a button 94 which bears against the base of stirrup 92.

The free ends of the legs of stirrup 92 carry connecting pins 96 which engage in recesses provided in the outer wall of holding member 6'.

When thumb wheel 90 is rotated, it advances parallel to the axis of product flow path section 22 and, through the intermediary of button 94, displaces stirrup 92 in the same direction. Holding member 6' moves together with stirrup 92 so as to deform spray nozzle member 4 in the same manner as described earlier herein with reference to the embodiment of FIGS. 1–4.

Other mechanisms for displacing holding member 6 in the same manner will be readily apparent to those skilled in the art.

Preferably, spray nozzle member 4 is made of, or flow passage 46 and spray opening 48 are coated with, an elastic material to which the product to be sprayed will not adhere. This will help to prevent clogging. If clogging should occur, it can frequently be cleared by opening spray opening 48 to its maximum size and using a suitable instrument to extract the dried product.

In practical embodiments of the invention, spray opening 48 will have a minimum diameter, and each of spray openings 58, 68, 78 and 88 will have a minimum transverse dimension, i.e. when the nozzle is not deformed, as small as 0.010" to 0.020". Larger minimum diameters or transverse dimensions will be needed to spray higher viscosity and texture materials.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A spray nozzle assembly comprising:

a support member defining a product flow path for conducting a flowable product which is to exit the nozzle assembly in the form of a spray;

a spray nozzle member providing a single spray opening communicating with the flow path, said spray nozzle member being operative for emitting the flowable product from the spray opening in a form determined by the size and shape of the spray opening; and a holding member for holding said spray nozzle member in position relative to said support member, wherein said spray nozzle member comprises an elastic material which is deformable in a manner to vary the size of the spray opening, and said holding member contacts said spray nozzle member uniformly in a circumferential direction around said spray opening and is movable relative to said support member to apply a deforming force in a direction parallel to the direction in which the flowable product is emitted from the spray opening for deforming the elastic material of said spray nozzle member to vary the size of the spray opening.

2. The assembly of claim 1, wherein the elastic material surrounds and delimits the spray opening, the spray opening has an axis, and said holding member is movable parallel to the axis of the spray opening for deforming the elastic material of said spray nozzle member.

3. The assembly of claim 2, wherein said spray nozzle member defmes a flow passage having an inlet end and an outlet end, the spray opening being located at the outlet end, said spray nozzle member is mounted on said support member for conducting the flowable product from the inlet end to the outlet end, and said spray nozzle member has an undeformed state in which the spray opening is smaller than the inlet end of the flow passage.

4. The assembly of claim 3, wherein the size of the spray opening increases as said spray nozzle member is deformed by said holding member.

5. The assembly of claim 4, wherein said spray nozzle member has an annular flange which is acted on by said holding member to deform the elastic material.

6. The assembly of claim 5, wherein said support member and said holding member have mating screw threads and said holding member is screwed onto said support member.

7. The assembly of claim 6, wherein the spray opening has an elliptical, oval, or circular cross section.

8. The assembly of claim 6, wherein the spray opening has a polygonal cross section.

9. The assembly of claim 6, wherein the spray opening has a stelliform cross section.

10. The assembly of claim 1, wherein said spray nozzle member defines a flow passage having an inlet end and an outlet end, the spray opening being located at the outlet end, said spray nozzle member is mounted on said support member for conducting the flowable product from the inlet end to the outlet end, and said spray nozzle member has an undeformed state in which the spray opening is smaller than the inlet end.

11. The assembly of claim 10, wherein the size of the spray opening increases as said spray nozzle member is deformed by said holding member.

12. The assembly of claim 1, wherein said spray nozzle member has an annular flange which is acted on by said holding member to deform the elastic material.

13. The assembly of claim 12, wherein said support member and said holding member have mating screw threads and said holding member is screwed onto said support member.

14. The assembly of claim 1, wherein the spray opening has an elliptical, oval, or circular cross section.

15. The assembly of claim 1, wherein the spray opening has a polygonal cross section.

16. The assembly of claim 1, wherein the spray opening has a stelliform cross section.

17. The assembly of claim 1, further comprising a manually operable mechanism coupled between said support member and said holding member for effecting translational movement of said holding member relative to said support member for deforming the elastic material of said spray nozzle.

18. The assembly of claim 17 wherein said mechanism comprises a thumb wheel which is coupled to said support member in a manner to be movable toward and away from said support member by rotation of said thumb wheel, and a linkage element coupled to said holding member and operatively associated with said thumb wheel for movement with said thumb wheel toward and away from said support member.

19. The assembly of claim 1 wherein said holding member is a manually movable member.

* * * * *